US007681694B2

(12) United States Patent
Aulanko et al.

(10) Patent No.: US 7,681,694 B2
(45) Date of Patent: Mar. 23, 2010

(54) ENERGY STORAGE SYSTEM FOR ELEVATORS

(75) Inventors: Esko Aulanko, Kerava (FI); Timo Syrman, Hyvinkää (FI); Sakari Korvenranta, Hyvinkää (FI); Pekka Jahkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 9 days.

(21) Appl. No.: 12/165,232

(22) Filed: Jun. 30, 2008

(65) Prior Publication Data

US 2008/0283341 A1 Nov. 20, 2008

Related U.S. Application Data

(63) Continuation of application No. PCT/FI2006/000407, filed on Dec. 8, 2006.

(51) Int. Cl.
*B66B 1/06* (2006.01)

(52) U.S. Cl. ..... 187/290; 187/277

(58) Field of Classification Search ..... 187/277, 187/290, 293, 295, 296, 297
See application file for complete search history.

(56) References Cited

U.S. PATENT DOCUMENTS

| | | | | |
|---|---|---|---|---|
| 4,657,117 | A | 4/1987 | Lauer | |
| 5,712,456 | A | 1/1998 | McCarthy et al. | |
| 5,896,948 | A * | 4/1999 | Suur-Askola et al. | 187/290 |
| 5,936,375 | A | 8/1999 | Enoki | |
| 6,474,447 | B2 * | 11/2002 | Tajima et al. | 187/290 |
| 6,742,630 | B2 | 6/2004 | Eilinger | |
| 6,938,733 | B2 * | 9/2005 | Eilinger | 187/290 |
| 7,228,942 | B2 * | 6/2007 | Takehara et al. | 187/290 |
| 7,246,686 | B2 * | 7/2007 | Smith et al. | 187/290 |
| 7,331,426 | B2 * | 2/2008 | Jahkonen | 187/290 |
| 2003/0089557 | A1 | 5/2003 | Eilinger | |

FOREIGN PATENT DOCUMENTS

| | | | |
|---|---|---|---|
| JP | 60-055804 | A | 4/1985 |
| JP | 61-240891 | A | 10/1986 |
| JP | 04-371464 | A | 12/1992 |
| JP | 2001-294381 | A | 10/2001 |
| JP | 2002-338147 | A | 11/2002 |

* cited by examiner

*Primary Examiner*—Jonathan Salata
(74) *Attorney, Agent, or Firm*—Birch, Stewart, Kolasch & Birch, LLP

(57) ABSTRACT

An elevator system and a method for reducing total power in an elevator system are provided. The elevator system includes at least one elevator without counterweight for moving people and/or goods. The elevator without counterweight comprises a power converter unit, an elevator motor, a traction sheave, a set of hoisting ropes and an elevator car. The elevator system also includes means for storing mechanical energy and discharging an energy storage.

20 Claims, 4 Drawing Sheets

1, 2: elevator w/o counter weight
3: weighted elevator
6: elevator control unit
7: electricity network
8, 11, 21, 31: power converter unit
12, 22, 32: motor
13, 23, 33: traction sheave
14, 24, 34: hoisting rope
15, 25: elevator car
36: weight 1, 2: elevator w/o counter weight
3: weighted elevator
4: energy storage means
6: elevator control unit
7: electricity network
8, 11, 21, 31, 41: power converter unit
12, 22, 32, 42: motor
13, 23, 33: traction sheave
14, 24, 34: hoisting rope
15, 25: elevator car
36: weight
47: flywheel

ENERGY STORAGE SYSTEM FOR ELEVATORS

This application is a Continuation of co-pending Application No. PCT/F12006/000407filed on Dec. 8, 2006, and for which priority is claimed under 35 U.S.C. § 120; and this application claims priority of Application No. 20051343 filed Finland on Dec. 30, 2005 under 35 U.S.C. § 119; the entire contents of all are hereby incorporated by reference.

FIELD OF THE INVENTION

The present invention relates to an elevator system as defined in the preamble of claim 1 and to a method for reducing the total power in an elevator system as defined in the preamble of claim 9.

BACKGROUND OF THE INVENTION

The power required by the hoisting machine of an elevator varies depending on factors including load, speed, traveling direction and phase of the operating cycle of the elevator. It is advantageous to keep the power requirement as small as possible to minimize both the size of the hoisting machine and the required mains connection size. A traditional solution designed to minimize the power needed to move an elevator car is to provide each elevator in the elevator system with a counterweight, which typically is so dimensioned that its mass corresponds to about 50% of the mass of the elevator car with full load. When the elevator is driven in the heavier direction, i.e. when an elevator car with a load above 50% is driven upwards or an elevator car with a load below 50% is driven downwards, the main direction of power transfer is from the electricity network towards the elevator motor. The largest instantaneous power is needed at the beginning of the operating cycle as the speed of the elevator car is being accelerated. When the elevator is driven in the lighter direction, the potential energy of the elevator car-counterweight combination is reduced, and the elevator motor converts mechanical energy into electric energy. The power generated when the elevator is being driven in the lighter direction or braked can be either dissipated in separate resistor packs or it can be fed back into the electricity network. Solutions are also known according to which in elevator groups comprising several elevators the power generated by one elevator can be utilized for driving other elevators comprised in the same elevator group in the heavier direction. However, supplying the power thus generated to other elevators in the elevator system requires that the starting order and traveling directions of elevators loaded in different ways be optimized so as to ensure that the energy flows in the system are in balance at each instant. This is not possible in all operating situations in the elevator system, in which case the power generated may have to be dissipated in resistors or in some other similar way. Another prior-art solution is to use energy storages in conjunction with the hoisting machines of an elevator system to allow the electric power produced by the elevator system to be stored so that it will be later available to the elevators comprised in the system. For example, specification US2003/0089557 A describes a system in which the power taken by an elevator system from the electricity network can be reduced by connecting supercapacitors and batteries to the power supply equipment of the elevator system. In this system, supercapacitors are used to smooth out instantaneous power peaks at the beginning of the operating cycle, and batteries are needed to reduce the required average power.

Using a counterweight in conjunction with each elevator car takes up building space that could often be advantageously used for other purposes. By omitting the counterweight, it is possible e.g. to accommodate a larger elevator car in an elevator shaft of a given size than in the case of elevators with counterweight. New efficient hoisting machine solutions have made it possible to increase the power of the elevator hoisting machine without unreasonably increasing the size of the hoisting machine, and the use of elevators without counterweight is gaining ground. In elevator systems having no counterweight, the power requirement of an elevator traveling in the heavier direction is greater than in counterweighted elevator systems. Correspondingly, when the elevator car is moving downwards, an elevator without counterweight produces more energy than a counterweighted elevator does. Large power transfers between the electricity network and the elevator system increase the requirements regarding the power supply as both the rated power and the harmonics content of the voltage and current is increased. Filters provided in the mains inverter of elevator systems are expensive when designed for high powers. It may also happen that the internal electric network of the building can not receive the power produced by elevators without counterweight, in which case the voltage in the internal electric network of the building will rise. When a building is to be provided with several elevators, as an elevator group or otherwise, the connection power required by the elevators easily increases to a level that makes it unreasonable to use elevators without counterweight in the building, although they offer a significant space saving.

By connecting energy storages to the electricity supply of the elevator e.g. in the manner indicated by specification US2003/0089557, a proportion of the energy produced by an elevator without counterweight during downward travel can be stored for later consumption. However, as the power generated by an elevator without counterweight is considerably greater than that produced by a counterweighted elevator, the size of supercapacitors needed to store the energy produced would increase significantly in the case of an elevator without counterweight, so the energy storage would be expensive and take up a large space. Furthermore, the service life of supercapacitors is limited, typically about 30 000 hours, and, due to leakage currents, they are particularly well suited only for short-term storage of energy. Optimization of elevator running schedules and prior-art electric energy storage solutions can not be regarded as offering an optimal solution for minimization of the size of the electric network connection of non-counterweighted elevator systems.

Specification U.S. Pat. No. 5,712,456 discloses an elevator system comprising one elevator and including a flywheel for storing the energy of the elevator.

Specification U.S. Pat. No. 5,936,375 discloses a hoisting equipment that comprises a flywheel used as an energy storage. The hoisting equipment according to this specification comprises one hoisting device. Moreover, the equipment comprises a flywheel and a motor and a power converter for controlling the flywheel.

In addition, specification U.S. Pat. No. 4,657,117 discloses an elevator system in which energy produced by one elevator is stored in a flywheel. The control apparatus controlling the elevator motor in this system is a Ward Leonard drive.

If the use of an elevator's energy storage is limited to one elevator, implementing an energy storage in an elevator system comprising a plurality of elevators will be complicated in practice. In that case each elevator needs a separate energy storage as well as separate equipment for the transfer of energy between the elevator motor and the energy storage.

OBJECT OF THE INVENTION

The object of the present invention is to disclose a new type of elevator system comprising elevators without counterweight, in which elevator system the mains connection power is lower than in prior-art systems.

BRIEF DESCRIPTION OF THE INVENTION

The elevator system of the invention is characterized by what is presented in the characterization part of claim 1, and the method of the invention is characterized by what is presented in the characterization part of claim 9. Other embodiments of the invention are characterized by what is disclosed in the other claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts.

The invention relates to an elevator system comprising at least one elevator without counterweight for transporting people and/or goods. The elevator without counterweight comprises a power converter unit, an elevator motor, a traction sheave, a set of hoisting ropes and an elevator car, and the elevator system further comprises means for storing mechanical energy and discharging an energy storage. The means for storing mechanical energy and discharging an energy storage may be arranged in a direct-voltage intermediate circuit of the elevator system, to which also the power converter unit arranged to control the elevator motor is connected. The means for storing mechanical energy and discharging an energy storage may comprise a weighted elevator, which comprises a weight, a set of hoisting ropes and a motor and a traction sheave for moving the weight by means of the set of hoisting ropes, and/or a flywheel and a motor. The elevator system may further comprise means for storing electric energy and discharging an energy storage.

In an embodiment of the invention, the elevator system comprises at least two elevators, and the power converter units of at least two elevators are connected to a common direct-voltage intermediate circuit. In an embodiment of the invention, the elevator system comprises at least two elevators without counterweight, and the power converter units of at least two elevators without counterweight are connected to a common direct-voltage intermediate circuit. In an embodiment of the invention, the elevators of the system are arranged as an elevator group, and in which elevator system the elevators and the means for storing mechanical energy and discharging an energy storage can be controlled by group control. In an embodiment of the invention, the elevator system further comprises means for enabling elevator operation in disturbance situations occurring in the electricity supply and/or in the power converter unit arranged between the electricity network and the direct-voltage intermediate circuit, and/or in failure situations occurring in the power converter unit arranged to control the elevator motor.

In the method of the invention for reducing total power in an elevator system, said elevator system comprising at least one elevator without counterweight for transporting people and/or goods, which elevator without counterweight comprises a power converter unit, an elevator motor, a traction sheave, a set of hoisting ropes and an elevator car, the elevator system is provided with means for storing mechanical energy and discharging an energy storage. To charge up the storage of mechanical energy, it is possible to use power obtained from the electricity network and/or power generated by an elevator motor comprised in the elevator system. The means for storing mechanical energy and discharging the energy storage can be utilized to reduce the average power in the elevator system and/or to reduce the peak power in the elevator system.

The elevator system and energy storage arrangement of the invention have the advantage of allowing economical use of non-counterweighted elevators as the connection power required by the elevator system and the main fuse size of the elevator system are smaller than in prior-art systems. Another advantage achievable by the invention is that electricity network harmonics can be more easily and economically suppressed in non-counterweighted elevator systems as the connection power is reduced and lower-power filters can be used. Furthermore, the invention can provide a saving in costs of the power converter unit between the electricity network and the elevator system as this unit can be designed for a lower power rating than conventionally.

Another advantage achievable by the invention is that energy can be stored for a long time, e.g. for the time between morning and afternoon peak traffic hours, but even for periods longer than this. Further, the energy storages in the elevator system of the invention are nature-friendly and durable, and they can be recharged an unlimited number of times.

LIST OF FIGURES

In the following, the invention will be described in detail by referring to a few examples and the attached drawings, wherein FIG. 1*a* represents an elevator system according to the invention FIGS. 1*b* . . . 1*f* visualize the positions of the elevator cars and weight of the elevator system according to FIG. 1*a* in the elevator shaft at certain instants of time.

DETAILED DESCRIPTION OF THE INVENTION

In non-counterweighted elevator systems, when the elevator car is moving downwards, potential energy of the elevator car is converted by the elevator motor into electric energy, and when the elevator car is moving upwards, its potential energy increases. As compared to counterweighted elevators, the instantaneous levels of power required and produced by non-counterweighted elevators are high. The power levels are proportional to the speed of the elevator. In the elevator system of the invention, one or more common energy storages are provided for an elevator or a number of elevators. The elevator system of the invention comprises at least one elevator without counterweight and means for storing mechanical energy and discharging an energy storage. When the elevator without counterweight is moving downwards, the change in potential energy of the elevator car can be at least partly converted into mechanical energy of the energy storage, and the energy stored in the energy storage can be utilized to move an elevator car comprised in the elevator system in the heavier direction or to brake the elevator car when it is moving in the lighter direction. This is to say that the means for storing mechanical energy and discharging the energy storage are controlled so as to reduce the total power in the elevator system to a level as low as possible. In this context, total power means the power taken from the electricity network by the entire elevator system or fed by it into the electricity network. The means for storing mechanical energy and discharging the energy storage can be used to reduce the average total power as well as the instantaneous peak power in the elevator system.

Figure 1A:
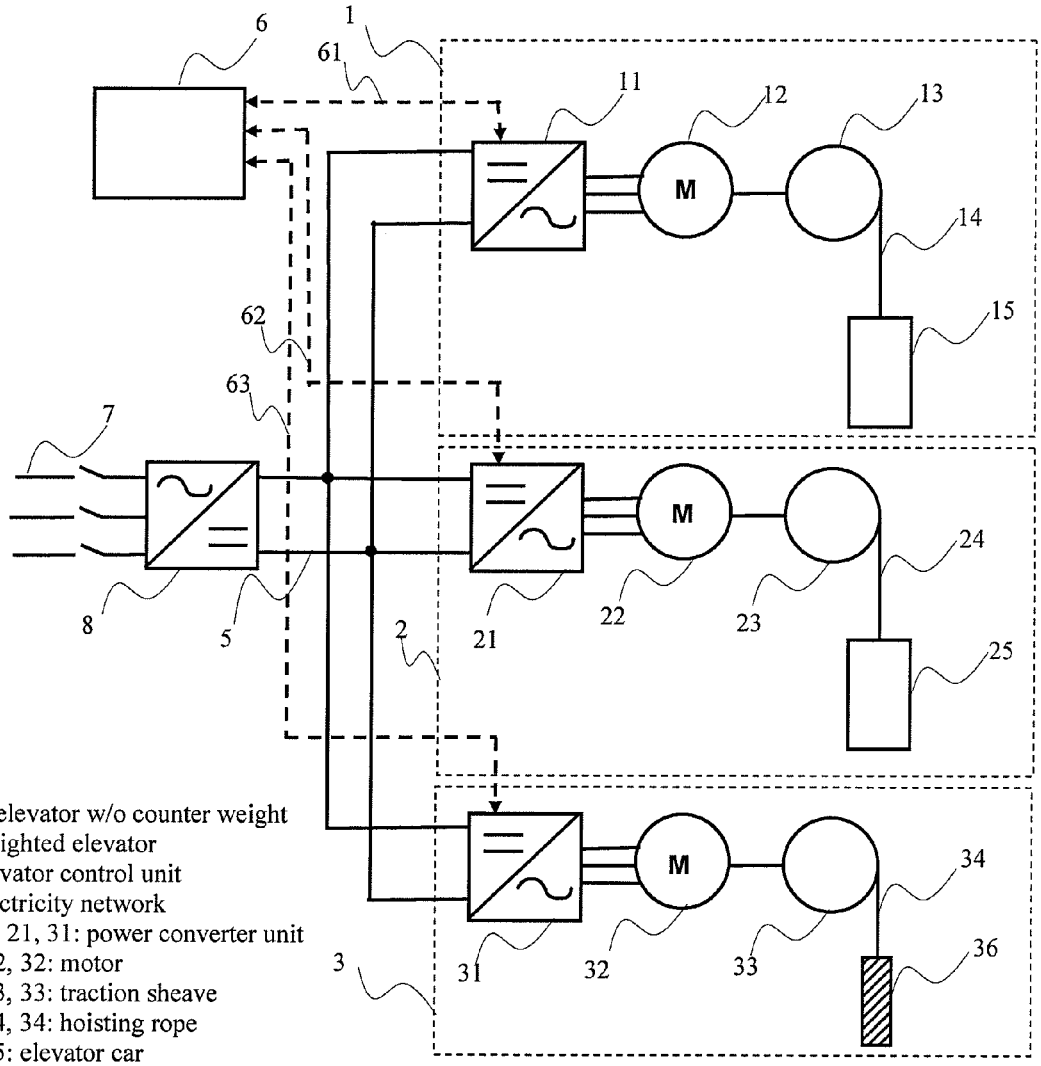

FIG. 1*a* presents an elevator system comprising two elevators 1 and 2 for transporting passengers and/or goods, each elevator comprising an elevator car 15, 25, a set of hoisting ropes 14, 24, a motor 12, 22 and a traction sheave 13, 23 for moving the elevator car 15, 25 in the elevator shaft by means of the hoisting ropes 14, 24, and a power converter unit 11, 21 for controlling the elevator motor 12, 22. The motors 12, 22 and 32 are preferably permanent-magnet axial-flux synchronous motors, but they may also be other motor types, such as radial-flux synchronous motors or induction motors. The traction sheaves 13, 23 are preferably coupled to the motor 12, 13 without a gear, but the invention is also applicable to elevator systems in which the hoisting machines comprise a gear. The elevator system may also comprise diverting pulleys arranged to support one of the sets 14, 24 or 34 of hoisting ropes. The elevator system further comprises means for storing mechanical energy. In the elevator system illustrated in FIG. 1*a*, these means are implemented using a third elevator 3 without counterweight, i.e. a so-called weighted elevator. The weighted elevator 3 comprises a weight 36, a set of hoisting ropes 34, a motor 32 and a traction sheave 33 for moving the weight 36 by means of the set of hoisting ropes 34, and a power converter unit 31 for controlling the motor 32. The weight 36 is a body having a sufficient mass, and it may structurally correspond to counterweights known from counter-weighted elevators, but it may also be implemented in some other suitable manner. For example, it is possible to use a weight arranged to be also utilizable for some other useful purpose, such as storage or transportation of goods. The elevator system further comprises at least one power converter unit 8 for rectifying the mains voltage, a direct-voltage intermediate circuit 5 and an elevator control unit 6, said control unit being arranged to communicate with the power converter units 11, 21 and 31 via channels 61, 62 and 63. The power converter unit 8 has been arranged to be connected to the electricity network 7. The power converter unit 8 is preferably a three-phase four-quadrant converter. All elevators in the elevator system are connected to a common intermediate circuit 5 or to several intermediate circuits connected together, but it is also possible that the system comprises one or more elevators which have a separate rectifier and intermediate circuit and which are connected to the other elevators via the alternating voltage network. The elevators in the elevator system preferably have a common electricity network connection with a common fuse.

Figure 1B:
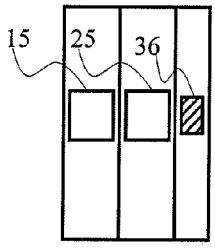

In the following, the operation of the elevator system illustrated in FIG. 1*a* is described in an example situation where a first user on the bottom floor calls an elevator car in order to reach the top floor of the building and, after the first user has started the journey, a second user arrives to the bottom floor and calls an elevator car in order to move to a floor midway in the building. In the starting situation in the example, elevator cars 15 and 25 and the weight 36 are midway in the elevator shaft as shown in FIG. 1*b*.

Figure 1C:
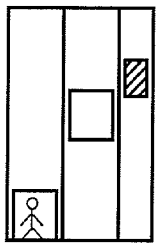

The call entered by the user is transmitted to the elevator control unit 6, which commands one of the power converter units 11, 12 of elevators 1, 2 to bring the elevator car 15, 25 to the bottom floor. If the command is given to elevator 1, then elevator car 15 will start moving downwards. Since the elevator 1 has no counterweight, moving the empty elevator car 15 downwards causes the motor 12 to produce electric power. The energy balance of the elevator system is monitored in the control unit 6. However, the means for monitoring the energy balance may also be arranged elsewhere than in conjunction with the control unit 6. When motor 12 starts to supply power via power converter unit 21 to the intermediate circuit, the control unit issues a command to power converter unit 31 to move the weight 36 upwards. The acceleration and speed of the weight 36 can be so adapted that at least a proportion of the power fed into the intermediate circuit by the elevator 1 is available for use to move the weight 36 or, if the weight 36 is located at a position where it cannot be moved, to offset the losses occurring in motor 32 and power converter unit 31. It is also possible to feed part of the electric power produced into the electricity network 7 or to auxiliary equipment (not shown in the figures) included in the elevator system. When elevator car 15 is arriving at the bottom floor, deceleration of the speed of the elevator car 15 is started. At least a proportion of the power needed for braking is obtained here from the weighted elevator 3 as deceleration of the upwards moving weight is started, and the energy corresponding to the change in the mechanical energy of the weight slowing down is converted into electric energy in motor 32 and fed to motor 12 via power converter units 11 and 31 and the intermediate circuit 5. FIG. 1*c* shows the positions of the elevator cars 15 and 25 and the weight 36 when elevator car 15 has arrived at the bottom floor.

Figure 1D:
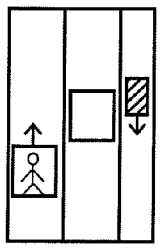
Figure 1E:
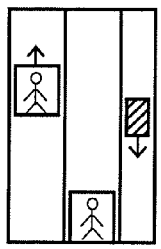
Figure 1F:
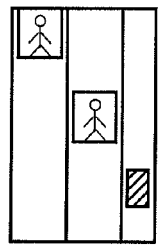

When the loaded elevator car 15 starts moving towards the top floor, at least a proportion of the power needed to move the elevator car can be obtained from the weighted elevator 3 as the weight 36 is moved downwards. FIG. 1*d* illustrates a situation where a second user calls an elevator to the bottom floor. When elevator car 25 is moving downwards, motor 22 supplies power via power converter unit 21 to the intermediate circuit 5, and at least part of this power can be further utilized in motor 15. The speed and acceleration of the weighted elevator 3 can be adapted so that at least a proportion of the difference between the power consumed by elevator 1 and the power generated by elevator 2 can be produced or stored by utilizing the changes in the mechanical energy of the weight. The positions of the weight 36 and the elevator cars in the elevator shafts after elevator car 25 has reached the bottom floor are shown in FIG. 1*e*. When elevator car 25 starts moving upwards, both elevator 1 and elevator 2 consume electric power. The weight 36 continues moving downwards, producing power for elevators 1 and 2, and, if necessary, some of the required power can be taken from the electricity network 7. The final situation, where the passengers of elevators 1 and 2 have reached the desired floors, is presented in FIG. 1*f*.

In the situation illustrated in FIGS. 1*c*-1*f*, the potential energy of the weight 36 is reduced, but the potential energy of elevator users having entered the building increases. When the users leave the building, a proportion of the change in potential energy occurring during the descent can again be stored in the weight 36. The example described above corresponds in a simplified form to a morning peak traffic situation in an office building, when most of the elevator users travel from the lower part of the building to higher floors.

The elevator system represented by FIG. 1*a* comprises two elevators for transporting passengers and/or goods, but according to the invention the system may also comprise only one elevator or more than two elevators. The elevators in the system may form one or more elevator groups, or the system may comprise a plurality of independent elevators. If the elevators form an elevator group, then the weighted elevator can be arranged to form part of the elevator system, and the regulation of energy flows so as to keep the total power in the elevator system at a low level can be implemented as part of the elevator group control.

The mass and suspension ratio of the weight 36 can be optimized to suit each elevator system. The factors affecting the selection of mass and suspension ratio of the weight include the number of elevators in the elevator system, height of the building and typical use of the elevator system. For example, in buildings where the elevator traffic mainly consists of full elevator cars traveling upwards and empty cars traveling downwards at certain hours and vice versa at other hours, it may be advantageous to use a weight having a large mass suspended with a large suspension ratio, allowing plenty of potential energy to be stored in the weight. Correspondingly, in buildings where the traffic flows are more variable, it may be advantageous to use a lighter weight and/or a weight with a lower suspension ratio, which, due to its smaller inertia, will help smooth out instantaneous power peaks. When a weighted elevator is used to store mechanical energy, the elevator system of the invention can also be conceived of as an elevator system with a number of elevators sharing a common counterweight. Another possibility is that the elevator system comprises more than one weighted elevator.

Although the weight moves in the elevator shaft in a manner corresponding to an elevator car, the weighted elevator does not require safety arrangements corresponding to those needed in the case of an elevator intended for the transportation of people/goods. Weighted elevators do require safety gears or equivalent means for preventing excessive increase of speed of the weight, but no safety circuit arrangements as usually required in elevators e.g. to prevent elevator motion while the car door is open are not needed in conjunction with a weighted elevator.

Figure 2:
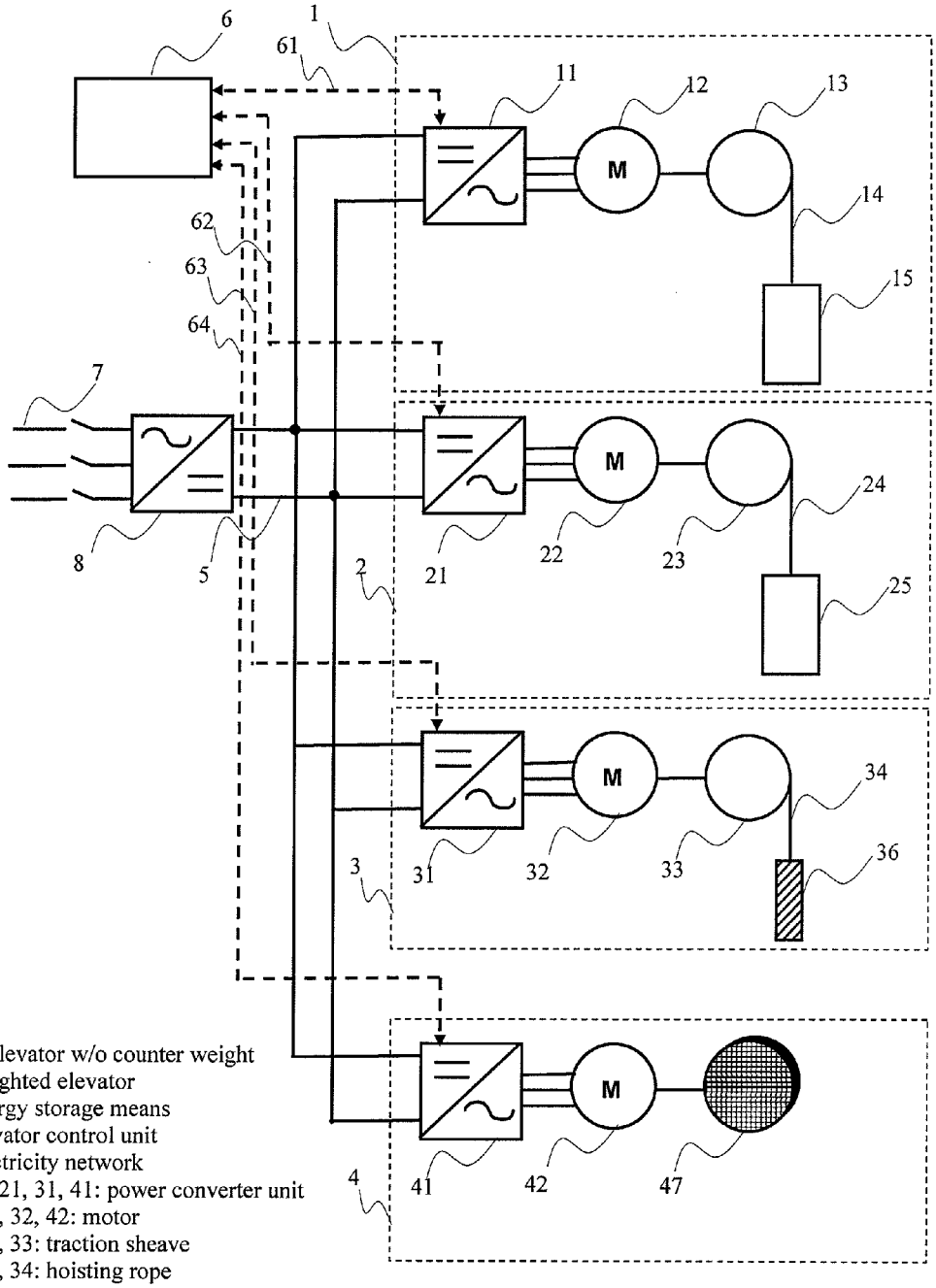
FIG. 2 represents a second elevator system according to the invention

FIG. 2 represents another elevator system according to the invention. The elevator system comprises components corresponding to those in the elevator system according to FIG. 1*a*, but the system additionally comprises second means 4 for storing mechanical energy and discharging an energy storage. According to FIG. 2, the second means for storing mechanical energy and discharging an energy storage comprise a power converter unit 41 arranged to be connected to an intermediate circuit and to communicate with a control unit 6 via a data transfer channel 64, a motor 42 and a flywheel 47. In addition to the weight 36, changes in the mechanical energy of the elevator car can be stored as kinetic energy of the flywheel by accelerating the flywheel 47 by means of the motor 42 when the elevator is supplying power into the intermediate circuit 5. The kinetic energy of the flywheel can be further converted into electric energy for use by elevators 1 and 2. The motor 42 may be a permanent-magnet axial-flux synchronous motor, but it may also be some other type of motor, such as e.g. repulsion motor, in which the magnetization is adjustable.

Depending on its mass and inertia moment, a flywheel may be easier than a weighted elevator to adapt to receive/produce power during power peaks occurring at the beginning of an operating cycle of the elevator. However, the kinetic energy of a flywheel is reduced with time due to frictional losses. If the energy is not needed in the system right after the flywheel has been put into rotation, it is also possible to further convert a proportion of the kinetic energy stored in the flywheel into potential energy of the weight to minimize frictional losses, or to feed it into the electricity network to make it available for use by other devices connected to the network.

The power converter unit comprised in the means for charging and discharging the energy storages may be a power converter unit identical to the one used for the supply of electricity to and control of the elevator motor, which allows advantages to be achieved in costs, reliability and maintenance activities as the converter is a well-tested and known mass product.

The energy balance of the elevator system of the invention can be optimized so that it is possible to operate the elevator system by taking from the electricity network only as much power as is required to offset the losses occurring in the elevator system, such as resistance losses in the motor and power converter units and frictional losses of the flywheel, and the consumption caused by peripheral devices. The connection power can thus be reduced to a very low level. However, in practice it is advisable to use a fuse rating that allows even larger power transfers between the electricity network and the elevator system.

It is also possible that, in addition to mechanical energy storages, the elevator system of the invention comprises means for storing electric energy, and these means may be e.g. batteries or supercapacitors.

Figure 3:
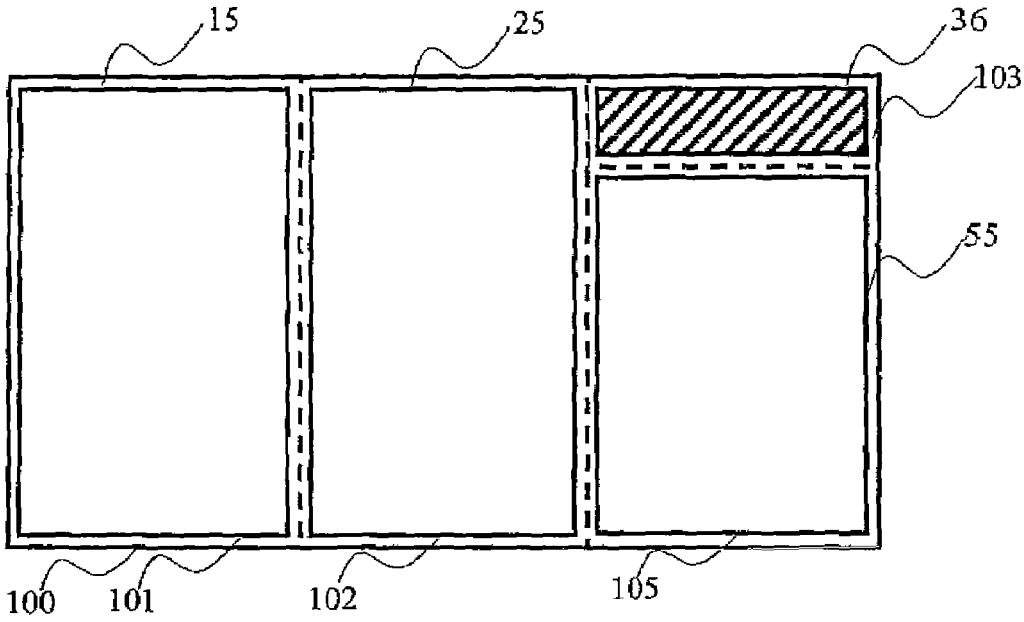
FIG. 3 represents the elevator shaft of an elevator system according to the invention in top view
Figure 4:
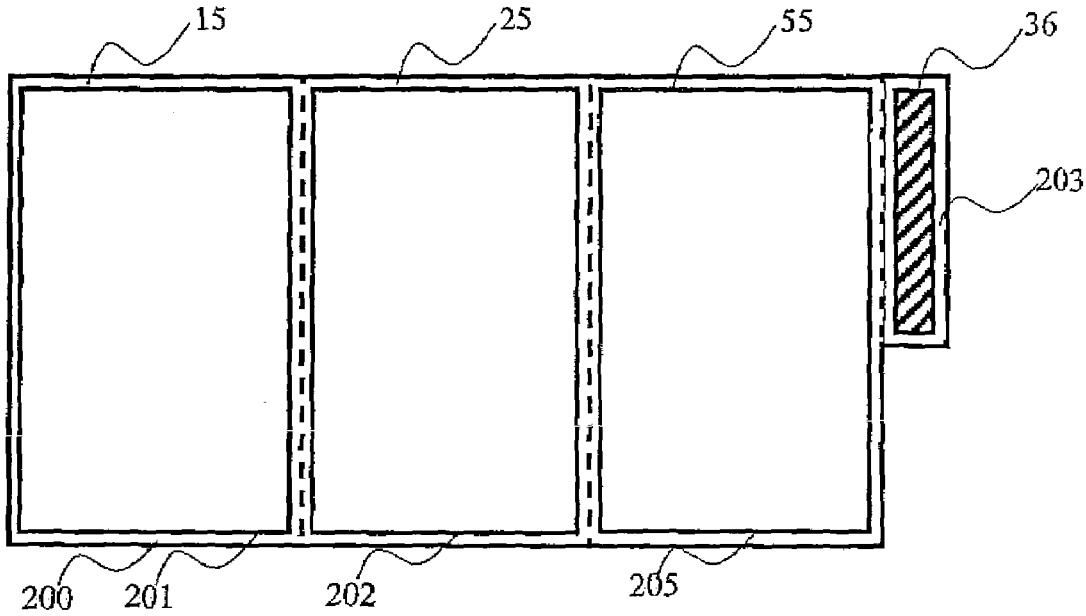
FIG. 4 represents the elevator shaft of another elevator system according to the invention in top view

The size and shape of the weight 36 and its position in the elevator shaft are optimizable so that it can be easily fitted in different shaft structures and elevator systems. FIGS. 3 and 4 present top views of shaft structures used in certain elevator systems according to the invention. FIG. 3 represents an elevator system with elevator cars 15, 25 and 55 and a weight 36 arranged in an elevator shaft 100. Provided for each car and the weight are guide rails (not shown in the figure), along which the cars and weight are arranged to move on their paths. The sections 101, 102, 105 and 103 of the shaft 100 where the elevator cars 15, 25 and 55 and the weight 36 are accommodated may be separated from each other e.g. by concrete walls, or they may form an undivided space where the guide rails of the elevators are fitted e.g. by using metal frames. In the example presented in FIG. 3, elevator car 55 is smaller than the other elevator cars, and the weight 36 is so placed that elevator car 55 and the weight 36 together take up as much space as elevator car 15 or 25. The arrangement presented in FIG. 3 may be advantageous e.g. in a situation where the elevator shaft 100 has previously housed counterweighted elevators which have later been replaced with elevators without counterweight. According to the invention, it is possible to install larger elevator cars than before in shaft sections 101 and 102 as the space required for the counterweight of the elevators previously housed in these shafts is freed up, and the electric network connection power of the non-counterweighted elevator system can be minimized by using a weight 36. Another possibility is to arrange the elevator hoisting machines in the elevator shaft, e.g. on its wall, ceiling or in some other convenient place.

FIG. 4 illustrates a shaft structure in which an elevator shaft 200 contains elevator cars 15, 25 and 65 and a weight 36 arranged in shaft sections 201, 202, 206 and 203 in such manner that each elevator car 15, 25 and 65 is the same size and a separate section 203, which may be smaller than sections 201, 202 and 206, is provided for the weight 36 outside the rectangular area formed by the shaft sections 201, 202, 206 intended for the elevator cars. Sections 201, 202 and 206 and the elevator cars placed in these may also be of mutually different sizes. It is also possible that some of the shaft sections have a greater height than others, e.g. so that only one of the elevators is arranged to run all the way to the topmost floor of the building while the path of the other elevator cars is arranged to extend only midway in the building. A further possibility is that the path of the weight 36 is arranged to be shorter than the paths of the elevator cars 15, 25 and 65.

The means for storing mechanical energy and discharging the energy storage in the elevator system of the invention can also be implemented in other ways than by using a weighted elevator or flywheel. The means for storing mechanical energy and discharging the energy storage can also be implemented e.g. by providing in conjunction with the elevator system a pump arrangement wherein water is pumped upwards into a water storage when the elevator motor is producing electric power and the energy stored in the water storage can be further utilized to produce power for the elevator motors.

In an embodiment of the invention, the elevator system comprises a weighted elevator and a flywheel 47, wherein the path of the weight 36 comprised in the weighted elevator is so arranged that the flywheel can be placed in the elevator shaft at least partially above or below the weight 36. It is also possible to place the flywheel 47 elsewhere, for example in the case of elevators with machine room, in the elevator machine room.

In an embodiment of the invention, the elevator system comprises at least two weighted elevators. It is possible, for example, to arrange in the elevator system two weighted elevators such that the weight of one of said weighted elevators has a mass and suspension ratio larger than those of the weight of the other elevator. In this case, the weighted elevator comprising a weight of greater mass is particularly well suited for the storage of larger quantities of energy and the other elevator for smoothing out fast power peaks.

In an embodiment of the invention, the mass of the weight 36 is so chosen that it corresponds to the mass of one elevator car comprised in the system with a full load.

In an embodiment of the invention, the mass of the weight 36 corresponds to the mass of two elevator cars with full load, but the mass of the weighted elevator may even be larger than this. In this embodiment, the suspension ratio of the weighted elevator is preferably larger than the suspension ratio of the other elevators in the system. By increasing the mass of the weighted elevator and correspondingly increasing its suspension ratio, the capacity of the energy storage can be increased without increasing the size or power of the hoisting motor of the weighted elevator.

In a preferred embodiment of the invention, the elevators in the elevator system are arranged as an elevator group, which is connected to the electricity network via a single main fuse. Each elevator comprises a power converter unit, each of which units comprises overcurrent monitoring and fuses in motor supply, said power converter units being connected to a common direct-voltage intermediate circuit of the elevator system. Group control of the elevators is preferably arranged to function in such manner that, in addition to the elevators intended for transporting people and/or loads, the group control system also controls the charging and discharging of the energy storages common to the elevator group so that the power taken from or produced into the electricity network by the elevator group and energy storage is as low as possible. At times when free transport capacity exists in the elevator system, it is also possible that the elevators of the elevator system that are intended for transporting people and/or goods are used for the storage of energy to increase the energy storage capacity.

The arrangement of the invention is also applicable to elevator systems comprising only one elevator without counterweight. In elevator systems consisting of one elevator without counterweight, designed e.g. for low-rise buildings and arranged to replace an earlier counterweighted elevator system, it is not necessarily possible to feed the power generated by the elevator motor into the electricity network. By the method of the invention, energy savings can be achieved as the feeding of energy into a resistor pack can be avoided or reduced. In the case of non-counterweighted elevator systems according to the invention, capacity restrictions of the electricity network are not encountered as in systems having no energy storage. It is also possible to use a single-phase electricity supply, in which case the use of small, economical rectifier units to rectify the mains voltage is possible as the system can be so adapted that only low power levels are transferred via the power converter unit and in one direction only.

An advantageous solution to implement the means for storing and discharging mechanical energy is a flywheel, which can be used to implement an energy storage at reasonable cost and in which energy storage it is possible to store a large amount of power as compared to prior-art energy storages. The rotational speed of the flywheel may be designed e.g. so that it is 5000 rpm at a maximum, but it may also be higher or lower than this. The flywheel can be coupled to the motor shaft either directly or via a gear. The moment of inertia of the flywheel can be chosen to suit the needs of the elevator system, but it may be e.g. of the order of 5 . . . 10 $kgm^2$ or more. Even small flywheels with an inertia moment below 5 $kgm^2$ may be used. The energy storage makes it possible to avoid the use of large braking resistors and/or to avoid increasing the voltage of the electricity network when the elevator motor is trying to feed electric power into the network.

Figure 5:
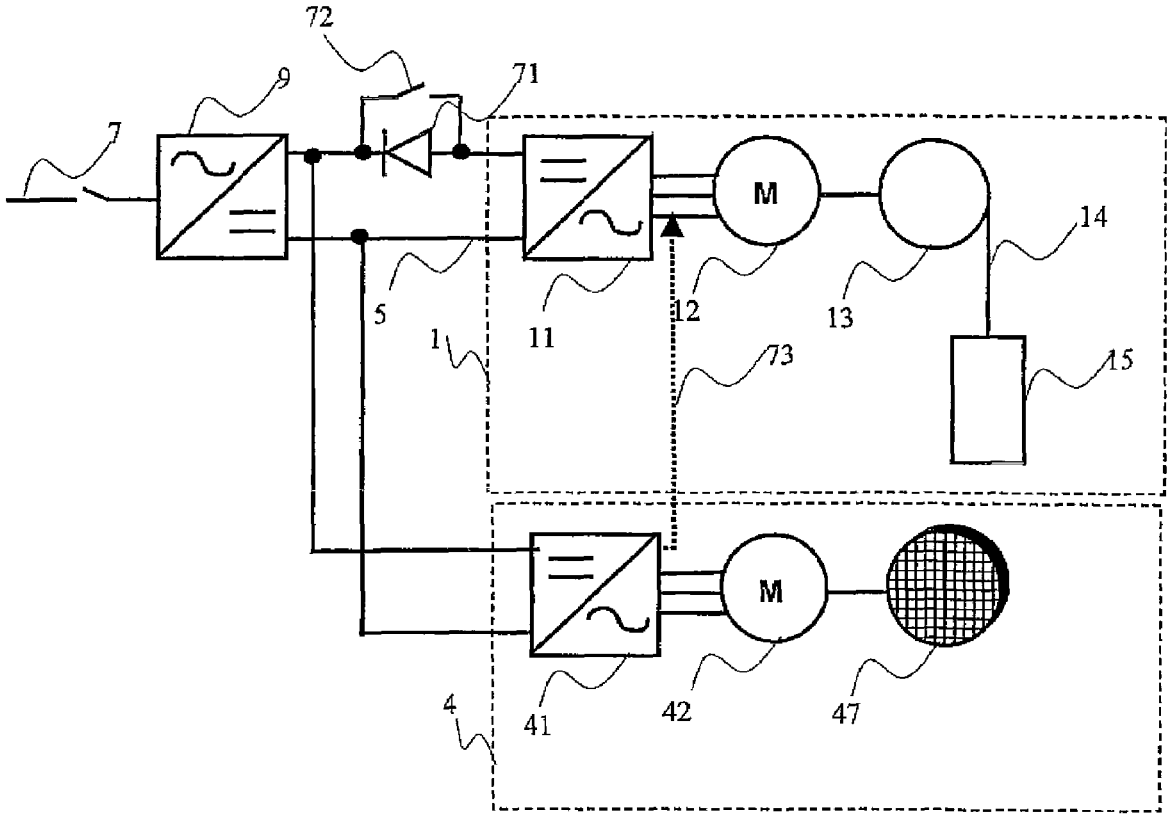
FIG. 5 represents a third elevator system according to the invention.

FIG. 5 represents an elevator system according to the invention comprising one elevator without counterweight. The reference numbers used in FIG. 5 correspond to those in FIGS. 1*a* and 2 where applicable. The elevator system according to FIG. 5 comprises one elevator 1 without counterweight, means 4 for storing mechanical energy and discharging an energy storage, a rectifier unit 9, which in the embodiment illustrated in FIG. 5 is a single-phase rectifier but which, according to the invention, may also be e.g. a three-phase four-quadrant rectifier. The means 4 for storing mechanical energy and discharging an energy storage are connected to a direct-voltage intermediate circuit 5, and they comprise a flywheel 47, a motor 42 and a converter unit 41. The system further comprises means 71 for enabling dynamic braking at full speed when the supply of electricity to the motor is interrupted by a contactor 72, and means for enabling elevator operation during a failure of converter unit 11, said means comprising a switch 73. The elevator system is usable for emergency transport even during failures of the electricity supply or rectifier unit 9 by taking the power needed for operation from the flywheel 47.

The elevator system according to FIG. 1 works as follows. Before the elevator is set in motion in the heavier direction, kinetic energy is accumulated in the flywheel by taking power from the electricity network 7 to accelerate the flywheel 47. The energy for the flywheel 47 can also be taken from the elevator 1 when it is running in the lighter direction. The energy storage may be charged e.g. for a few tens of seconds before operation of the elevator is started. When the elevator car 15 is driven in the up direction, a proportion of the power required for lifting the elevator car is taken from the energy storage 4 and another proportion from the electricity network 7 if necessary. Thus, a rectifier unit 9 with a low power rating can be used as the peak power flowing through it can be limited. Power converter unit 41 can now function as an uncontrolled six-pulse diode rectifier. When the elevator car 15 is moving downwards, energy is supplied to the flywheel 47, with power converter unit 41 functioning as an inverter. Depending on factors including capacity of the energy storage, velocity and load of the elevator 1 and structure of power converter unit 9, the system may further comprise, if necessary, a resistor pack and/or a possibility to supply power to the electricity network 7, but the energy storage 4 can also be so designed as to obviate the need for a resistor pack or a possibility to supply power to the electricity network. In the system in FIG. 5, it is also possible to arrange for the motor to brake dynamically e.g. in the event of failure of the brake. In connection with dynamic braking, energy can be supplied to the flywheel 47, and dynamic braking is possible even at full speed. Dynamic braking is made possible by a diode 71, through which power flows to the flywheel when the supply of electricity to the motor has been interrupted by the contactor 72. During failures of power converter unit 11, the supply of power from the electricity network 7 to the motor 12 can be arranged to take place via power converter unit 41 by connecting the output of the power converter 41 to the motor 12 by means of a switch 73. It is also possible to add to the elevator system in FIG. 5 a switch that allows the power converter unit 41 to be used as a rectifier in place of unit 9 when this unit 9 fails.

In an embodiment of the invention, the voltage of the intermediate circuit 5 has been increased to a value higher than the mains voltage 7, e.g. to 600 . . . 700 V to minimize the sizes of the power converter units. In an embodiment of the invention, the capacitor of the direct-voltage intermediate circuit is arranged to be small, so the direct voltage link of the elevator system need not be separately charged.

In cases of failure of electricity supply to an elevator system, it has traditionally been necessary to use emergency power, such as batteries, to transport elevator passengers to the nearest landing. Batteries involve problems including a short service life and the fact that, as the batteries are seldom used, they are not necessarily in working order when needed. In an embodiment of the invention, the energy storage of the elevator system can be used for moving the elevator car in cases of failure of the electricity supply. It is also possible to use the energy stored in the energy storage as emergency power in situations where a failure occurs in the power converter unit between the electricity network and the direct-voltage intermediate circuit of the elevator system. Rectification of the power produced by the emergency power generator, i.e. in this case by the motor used for charging and discharging the energy storage, can be implemented using a simple six-pulse rectifier. Of the energy stored in the flywheel, it is possible to utilize as much as 95% for emergency power operation.

In the case of elevators without machine room, it is often necessary to move the elevator car in disturbance situations already for the reason that the elevator machinery or its parts have to be accessed for inspection, servicing or repair work. In an embodiment of the invention, the elevator system is an elevator system without machine room, in which elevator system at least the elevator hoisting machine and the equipment required for electricity supply to the elevator are placed in the elevator shaft or in its vicinity so that no separate machine room is provided for them. By using energy obtained from the energy storage, the elevator car can be moved to a position where it does not obstruct access to places that need to be accessed in order to carry out maintenance and/or repair operations.

The elevator system of the invention can be implemented using different supply voltages, such as voltages of e.g. 230 V or 400 V, but even voltages higher than this are possible.

In an embodiment of the invention, the elevator system comprises a low-power, e.g. about 2-kW rectifier unit, which may be e.g. a single-phase 230-V rectifier or a three-phase 400-V rectifier, a power converter unit for feeding the motor, which may have a power rating of e.g. about 10 kW, a power converter unit for feeding the motor driving the flywheel, which may be a 10-kW converter unit similar to the power converter unit arranged to feed the elevator motor, a permanent-magnet synchronous motor, and a flywheel coupled to it.

In an embodiment of the invention, the means for storing mechanical energy and discharging the energy storage comprise a power converter unit corresponding to the power converter unit of one of the elevators in the elevator system. This makes it possible to minimize the maintenance and servicing costs while further improving the reliability of the power converter units. In an embodiment of the invention, the means for storing mechanical energy and discharging the energy storage comprise a motor of a type corresponding to one of the elevator motors used in the elevator system.

The inventive concept also comprises a method for reducing the total power consumed by an elevator system in the case of an elevator system comprising at least one elevator without counterweight for transporting people and/or goods, said elevator without counterweight comprising a power converter unit, an elevator motor, a traction sheave, a set of hoisting ropes and an elevator car. In the method of the invention, means for storing mechanical energy and discharging an energy storage are provided in the elevator system. By this method, the average total power consumed by the elevator system can be reduced, because power transfer between the elevator system and the electricity network can be minimized by appropriately charging and discharging the energy storage. Further, the method makes it possible to reduce the peak power taken by the elevator system from the electricity network as the energy stored in the energy storage can be used besides power taken from the electricity network during those phases of the operating cycle of the elevator that require the most power, typically at the beginning of the operating cycle. To charge up the storage of mechanical energy, it is possible to use power obtained from the electricity network and/or power generated by the motor of one of the elevators comprised in the elevator system, or it is also possible to charge the storage of mechanical energy with power taken from another energy storage.

The invention is not exclusively limited to the above-described embodiment examples, but many variations are possible within the scope of the inventive concept defined in the claims.

The invention claimed is:

1. An elevator system, said elevator system comprising:

at least one elevator without counterweight for moving people and/or goods, said elevator without counterweight comprising:

a power converter unit, an elevator motor, a traction sheave, a set of hoisting ropes, and an elevator car; and means for storing mechanical energy and discharging an energy storage, wherein the means for storing mechanical energy and discharging an energy storage comprises a weighted elevator, said weighted elevator comprising a weight, a set of hoisting ropes, a motor, and a traction sheave, wherein the power converter unit of the at least one elevator without counterweight for moving people and/or goods and the weighted elevator are connected to a common direct-voltage intermediate circuit.

2. The elevator system according to claim 1, wherein the means for storing mechanical energy and discharging an energy storage are arranged in the direct-voltage intermediate circuit of the elevator system, to which circuit is also connected a power converter unit arranged to control the elevator motor.

3. The elevator system according to claim 1, wherein the means for storing mechanical energy and discharging an energy storage comprise a flywheel and a motor.

4. The elevator system according to claim 1, wherein the elevator system further comprises means for storing electric energy and discharging a storage of electric energy.

5. The elevator system according to claim 1, wherein the elevators of the system are arranged as an elevator group, and in which elevator system the elevators and the means for storing mechanical energy and discharging an energy storage are controllable by group control.

6. The elevator system according to claim 1, wherein the elevator system further comprises means for enabling elevator operation in failure situations occurring in the electricity supply and/or in the power converter unit arranged between electricity network and the direct-voltage intermediate circuit.

7. The elevator system according to claim 1, wherein the elevator system further comprises means for enabling elevator operation in failure situations occurring in the power converter unit arranged to control the elevator motor.

8. A method for reducing the total power in an elevator system, the method comprising:

providing said elevator system comprising at least one elevator without counterweight for transporting people and/or goods, said elevator without counterweight comprising a power converter unit, an elevator motor, a traction sheave, a set of hoisting ropes and an elevator car, providing a weighted elevator having a power converter unit, and storing mechanical energy and discharging an energy storage in the elevator system using the weight elevator and the power converter unit of the weight elevator.

9. The method according to claim 8, further comprising charging the storage of mechanical energy using power obtained from electricity network.

10. The method according to claim 8, further comprising charging the storage of mechanical energy using power generated by the motor of an elevator comprised in the elevator system.

11. The method according to claim 8, further comprising reducing the average power in the elevator system using means for storing mechanical energy and discharging the energy storage.

12. The method according to claim 8, further comprising reducing peak power in the elevator system using means for storing mechanical energy and discharging the energy storage.

13. The elevator system according to claim 2, wherein the means for storing mechanical energy and discharging an energy storage comprises a flywheel and a motor.

14. The elevator system according to claim 2, wherein the elevator system further comprises means for storing electric energy and discharging a storage of electric energy.

15. The elevator system according to claim 3, wherein the elevator system further comprises means for storing electric energy and discharging a storage of electric energy.

16. The elevator system according to claim 2, wherein the elevators of the system are arranged as an elevator group, and in which elevator system the elevators and the means for storing mechanical energy and discharging an energy storage are controllable by group control.

17. The elevator system according to claim 3, wherein the elevators of the system are arranged as an elevator group, and in which elevator system the elevators and the means for storing mechanical energy and discharging an energy storage are controllable by group control.

18. The elevator system according to claim 4, wherein the elevators of the system are arranged as an elevator group, and in which elevator system the elevators and the means for storing mechanical energy and discharging an energy storage are controllable by group control.

19. The elevator system according to claim 2, wherein the elevator system further comprises means for enabling elevator operation in failure situations occurring in the electricity supply and/or in the power converter unit arranged between the electricity network and the direct-voltage intermediate circuit.

20. The elevator system according to claim 3, wherein the elevator system further comprises means for enabling elevator operation in failure situations occurring in the electricity supply and/or in the power converter unit arranged between electricity network and the direct-voltage intermediate circuit.

* * * * *